US006872107B1

(12) United States Patent
Paulo

(10) Patent No.: US 6,872,107 B1
(45) Date of Patent: Mar. 29, 2005

(54) BOAT HULL TUNNEL EXTENSION

(76) Inventor: Douglas G. Paulo, 20675 Forest Ave., Castro Valley, CA (US) 94546

( * ) Notice: Subject to any disclaimer, the term of this patent is extended or adjusted under 35 U.S.C. 154(b) by 0 days.

(21) Appl. No.: 10/629,539

(22) Filed: Jul. 29, 2003

(51) Int. Cl.[7] ..... B63H 5/16
(52) U.S. Cl. ..... 440/69; 114/271
(58) Field of Search ..... 440/69, 70; 114/271

(56) References Cited

U.S. PATENT DOCUMENTS 835,530 A * 11/1906 Huff ..... 440/69
3,515,087 A * 6/1970 Stuart ..... 440/70
3,626,894 A * 12/1971 Stuart ..... 440/69
3,793,980 A * 2/1974 Sherman ..... 440/69
3,811,399 A * 5/1974 Kobayashi et al. ..... 440/69
4,057,027 A * 11/1977 Foster ..... 440/69
4,609,360 A * 9/1986 Whitehead ..... 440/69
6,544,081 B1 * 4/2003 Paulo ..... 440/69

* cited by examiner

*Primary Examiner*—Lars A. Olson
(74) *Attorney, Agent, or Firm*—George W. Wasson

(57) ABSTRACT

A boat hull having a tunnel structure along the bottom of the hull in the form of a truncated hollow partial cone indentation and extension parallel to the keel of the boat. The tunnel has a cone shape and has a truncated end attached to the bottom of the hull near the keel and a constant radius extension to an open end attached to the transom of the boat. The tunnel encloses a propeller shaft extending from the boat interior at the truncated end is cone shaped to the position of a propeller partially within the tunnel and then has a constant radius extension to the transom of the hull. The tunnel extension directs the forces from the propeller to the stern of the boat and the increased area surface of the bottom in a manner that increase the lift on the stern to assist in getting the boat into planing attitude from a starting attitude.

7 Claims, 2 Drawing Sheets

BOAT HULL TUNNEL EXTENSION

BACKGROUND OF THE INVENTION

1. Field of the Invention

This invention relates to a boat hull having a bow, a stern, and a keel along its bottom extending from the bow toward the stern and more particularly to a tunnel structure along the bottom of the boat hull in the form of a truncated hollow partial cone and extension indentation parallel to the keel of the boat. The cone indentation has a central axis that is aligned parallel to the keel of the boat in the bow to stern axis of the boat and at an angle downward from the lay of the keel from the bow to the stern of the boat. The cone indentation begins near the apex of the cone and extends at a constant cone angle toward the stern of the boat to the position of a propeller within the cone and then extends from the position of the propeller at a constant radius from the cone is axis to the transom where the base of the indentation is secured to the stern or transom of the boat hull. The partial cone shaped tunnel accommodates the rotary propeller of the boat, and is truncated near its apex where, at that location, it is attached to the keel of the boat and provides a step through which the propeller shaft to the propeller passes from the interior of the boat.

The present invention is an addition to and improvement on the hull shown and claimed in my U.S. Pat. No. 6,544,081, issued Apr. 8, 2003 for BOAT HULL WITH TUNNEL STRUCTURE.

2. Description of the Prior Art

Prior art patents have disclosed the use of tunnel shapes along the keel of a boat for several different purposes. Stuart, U.S. Pat. No. 3,515,087, discloses a hull tunnel that smoothly increases in size and diameter as extending aft to open fully at the stern. Stuart, U.S. Pat. No. 3,626,894, discloses a tunnel in the bottom of the boat that extends aft of the propeller a short distance with a gradually enlarging cross-sectional area preferably formed by diverging sidewalls of the tunnel. Fisher, U.S. Pat. No. 3,745,963, discloses a tunnel structure designed to converge water flow and increase water pressure aft of the propeller. Shirley, U.S. Pat. No. 4,392,448, discloses the prior art structures intended to produce desireable wake patterns for water skiing. Whitehead, U.S. Pat. No. 4,609,360, discloses a tunnel having a section aft of a propeller with side surfaces that widen the tunnel toward the transom. Hankley, U.S. Pat. No. 4,622,061, discloses a tunnel with a wedge postioned in the tunnel aft of the propeller. All of Hankley's wedges reduce the tunnel diameter aft of the propeller and along the sides of the tunnel. The prior art has not directed the hull design to the desire to increase the efficiency of the drive from the boat's motor to the propeller and aft of the propeller through the hull and to increase efficiency of driving the boat into a planing attitude.

In an inboard powered boat, it is desireable to have the axis of the propeller shaft as near as possible to parallel to the keel of the boat. It is also desireable to place the driven propeller in its most efficient alignment with the water surface during initial acceleration and after the boat has attained its planing attitude or speed. The prior art has not addressed the angle of the propeller shaft exit from the hull of the boat and the angle of the propeller shaft to the hull of the boat at the position of the propeller when in driving contact with the water. Further, where boat hulls have been provided with bottom concave depressions, those depressions have not been designed to increase the efficiency of the propeller drive forces aft of the propeller blades to raising the stern into a planing attitude.

SUMMARY OF THE INVENTION

The present invention is a modification of the hull of a boat by installing a concave partial cone shaped section along the hull forward of the propeller with the propeller shaft running near the central axis of the partial cone shape and a constant diameter aft of the propeller to the stern. The partial cone shaped section produces a slot or tunnel indentation running longitudinally from the keel, where the propeller shaft exits through the bottom of the hull, to the transom at the stern of the boat. The slot or tunnel is aligned at an angle of approximately 6° to 12° upward from the keel to the position of the propeller and then parallel to the keel toward the transom. The angle and length of the slot is related to the diameter of the propeller which rotates partially in the slot and is related to the length of the propeller shaft. In the design of the present invention, the propeller shaft exits from the keel of the boat at about 1° to 5° down from the lay of the keel, depending upon the configuration of the bottom of the boat. The relationship of the angle of the slot to the keel and the exit angle of the propeller shaft is calculated to place about 45% to 50% of the propeller turning inside the slot tunnel when the boat is at its planing speed and attitude. The connection of the cone near its apex to the hull causes air to be introduced into the cone along with water to produce an air slot at the hull. Aft of the propeller the tunnel radius is constant to its connection with the transom at the stern.

The purpose of the partial cone shaped tunnel slot of the present invention in the hull of a boat is four fold. The cone shaped air slot allows the suction of the water to be broken at planing through cruising speeds, making it a surface drive, but safer because all of the components are under the boat, unlike other existing surface drives. The cone shaped air slot allows the propeller shaft to be mounted almost parallel to the lay of the keel of the bottom of the boat. The cone shaped air slot and the alignment of the propeller shaft in the slot allows the boat to be operated in shallower waters, increases efficiency and reduces fuel consumption. The shape of the tunnel aft of the propeller and to the stern is at a constant radius to assist in lifting the stern into planing position.

It is an object of the present invention to improve the efficiency of a boat by modifying the bottom of the boat to permit desired angles of cone-to-keel and propeller-to-keel in the boat hull.

A further object in accord with the preceding object is the formation of a partial cone shaped hollow tunnel slot along the hull of a boat with a continuous cone angle from the lay of the keel to the position of the propeller within the tunnel and then a constant diameter for the tunnel aft of the propeller to the transom of the boat.

A further object in accord with the preceding objects is to assist in lifting the stern of the boat into planing position so that the propeller is operating with about one half of its blades within the tunnel and out of contact with the water under the boat.

Further objects and features of the invention will be readily apparent to those skilled in the art from the appended drawings and specification illustrating preferred embodiments wherein:

DETAILED DESCRIPTION OF THE PREFERRED EMBODIMENT OF THE INVENTION

Figure 1:
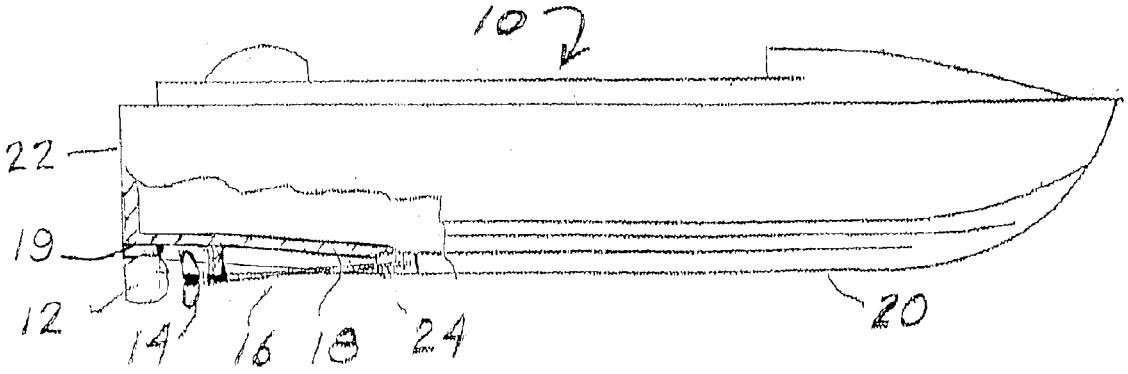
FIG. 1 is a side view, partially in section, of a V-shaped hull boat with a partial cone shaped tunnel slot and extension of the present invention.
Figure 2:
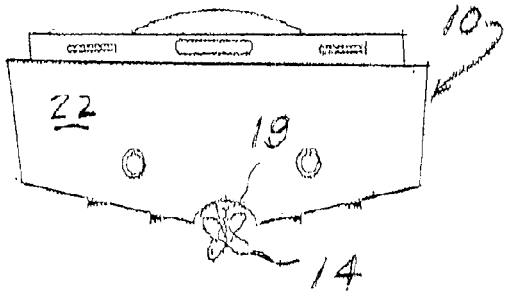
FIG. 2 is a rear elevation of the boat hull of FIG. 1.

FIG. 1 illustrates an embodiment of the present invention in a V-shaped hull boat 10 with a portion of the stern of the boat removed to show the rudder 12, the propeller 14, propeller shaft 16 and the partial cone shaped tunnel slot 18 and its constant radius portion 19 extending from the keel 20 toward the transom 22. The propeller shaft 16 extends from the interior of the boat through the truncated end 24 of the tunnel slot 18. The internal boat engine is not shown and it should be well understood how the engine is connected through a transmission to the propeller shaft to exit from the boat hull through a suitable stuffing box and sealing bearing. FIG. 2 illustrates the stern of the boat showing the propeller 14 within the open end of the tunnel slot 18 and extension portion 19.

Figure 3:
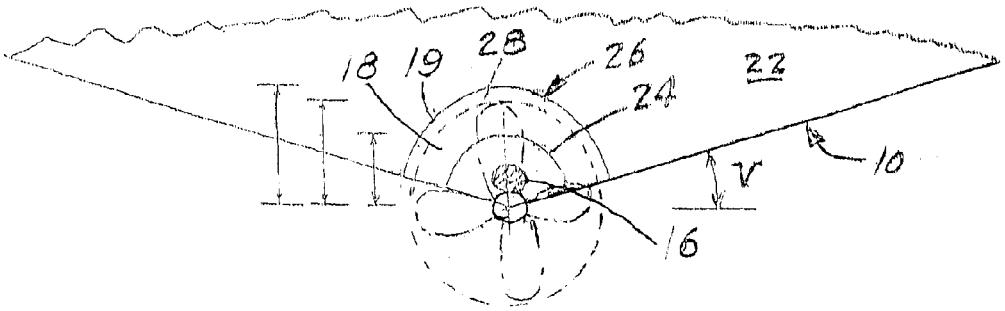
FIG. 3 is an enlarged partial rear elevation of a boat hull like FIG. 1 without propeller and rudder and showing the approximate diameter of the tunnel slot at the transom, at the propeller and at the entry of the propeller shaft from the hull to the slot.

FIG. 3 illustrates an enlarged view of the stern or transom 22 of the boat hull 10. At the transom, the open end of the tunnel cone 18 extension 19 connects with the transom at 26 in a circular arc. The internals of the cone 18 include the truncated end 24 where the cone is connected to the hull at the keel 20. Also shown in dotted lines is the circumference of the path 28 of the tip of a propeller 14 (shown in phantom lines). The position of the propeller shaft 16 within the cone shaped tunnel slot as it exits from the truncated end is shown in section as well as it position where the propeller is mounted.

Figure 4:
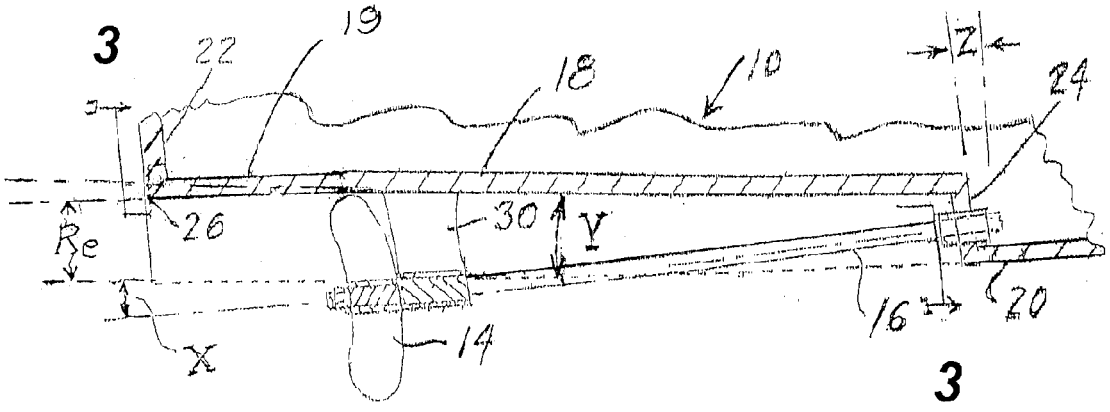
FIG. 4 is a partial sectional view illustrating the cone angle, the extension radius and propeller shaft angle with respect to the lay of the keel of a boat.

FIG. 4 illustrates an enlarged stern portion of the boat hull 10 with the tunnel slot 18 and extension 19 shown in section. The cone shaped tunnel slot extension 19 is attached to the stern 22 at its open end 26 and to the cone portion at the location of the propeller 14. The truncated end closure 24 of the cone portion 18 is attached to the boat hull 10 at the keel 20. The propeller 14 is shown at the end of the propeller shaft 16 where the shaft is supported by a strut 30 fixed to the interior of the tunnel slot 18. The strut includes suitable bearings for rotary support of the shaft. The shaft 16 passes through the truncated end 24 of the tunnel slot 18 at its connection to the hull 10 at about the keel 20; a suitable bearing and stuffing box seals the shaft at the exit from the hull. The rudder, not shown, would be toward the transom and behind the propeller either within the tunnel slot extension 19 or aft of the transom. Twin rudders could be mounted to the hull separately from the tunnel.

Shown in FIG. 4 in angular arrows is the angle X between the lay of the keel and the axis of the propeller shaft 16, the angle Y between the lay of the keel and the axis of the partial cone shaped tunnel slot 18 to the position of the propeller with the constant radius extension 19 aft of the propeller, and the angle Z between the truncated end 24 of the tunnel slot 18 where it is almost perpendicular to the lay of the keel and normal to the axis of the propeller shaft. The difference between the radius of the cone portion of the tunnel slot 18 at the location of the propeller and the radius of the extension 19 aft of the propeller represented by the distance marked $R_e$. The projection of the cone radius to the transom without the reduction in radius for the extension 19 is shown in dot-dashed lines above $R_e$.

The "lay of the keel" means the generally straight line of the keel toward the transom and represents the part of the boat that will be in contact with the water when the boat has obtained planing attitude or speed. "Normal to the axis of the propeller shaft" means a truncation of the cone shape at an angle that will provide the desired entry of the propeller shaft from the interior of the boat hull to the interior of the cone. The exit of the propeller shaft through a truncation as close as possible to perpendicular to the shaft will permit better sealing at the exit bearing. It is the intent of the alignments of the present invention to place the axis of the propeller shaft as flat as possible, that is horizontal, when the boat is in it planing attitude. It is also the intent of the present invention to position the propeller within the cone tunnel in a position where at least half of the propeller is engaging the water as the boat is propelled. To accomplish those intents, the cone tunnel starts far ahead of the propeller location and tapers upward from the keel toward the stern. The forward end of the cone tunnel is truncated at its attachment to the boat at the keel to establish a step that breaks the suction between the hull and the water and provides a path for water and air to enter the cone to a position for engagement with the propeller. The cone angle of the tunnel is a constant angle from the keel attachment to the position of the propeller within the cone. At the position of the propeller, the tunnel then has a constant radius extension $R_e$ to the transom and is a constant circular partial cone with a constant radius extension each having a thickness consistant with the thickness of the hull, open at the bottom to establish a hollow partial cone 18 and extension 19, with the sides of the cone and extension attached to the hull of the boat along the edges of the cone and extension from the connection to keel 20 at the truncated end to the connection of the extension to the transom 22.

As shown in FIG. 4, the angle X between the lay of the keel and the axis of the propeller shaft is preferably as small as possible. The design of the engine and transmission in providing power to the propeller shaft requires that there be some angle to get the shaft out of the hull. In accord with the present invention, the angle X should be between 1° and 5°. The angle Y between the axis of the cone tunnel and the lay of the keel is, to some extent, determined by the diameter of the propeller and the position of the propeller within the cone. In accord with the present invention, the angle Y should be between 6° and 12° upward from the keel to the propeller position in the tunnel and then constant to the transom. The angle between the axis of the propeller shaft and the interior surfaces of the cone should be between about 5° and 10°. The angle Z between the small truncated end of the cone at its attachment to the keel and almost perpendicular to the keel is determined to some extent by the axis of the propeller shaft. In accord with the present invention, the angle Z is the same as the propeller shaft angle with respect to the lay of the keel. The diameter $R_e$ of the extension 19 is determined by the diameter of the propeller and its position within the cone shaped portion. The propeller should have a clearance of about 1 inch to the interior surface of the cone at the extension. That distance in radius for the extension then remains constant to the connection with the transom.

An example of a boat that could be constructed using the design features of the present invention is illustrated in FIGS. 1–4 as a Vee hull boat about 21 feet in length with a beam of 95.5 Inches. In that boat, the Vee angle is 15°, shown at V in FIG. 3. The length of the cone tunnel and extension placed within the hull is 60" from the transom to the truncated end. The angle X between the lay of the keel and the axis of the propeller shaft is 3°, the angle Y of the cone tunnel interior surfaces with respect to the axis of the propeller shaft is 7°, the angle Z is 3° In such a boat, the cone is about 7 inches in radius at the propeller location, the radius of the aft extension of the tunnel from the propeller remains at 7 inches, and the radius of the truncated end connected to the keel forward of the propeller is about 4 inches. The tunnel extension in such a boat would be about 14 to 18 inches from the transom to the propeller with the strut forward of the propeller. These dimensions are representative of the angles and lengths and are varied depending upon the hull design, the length of the hull, the selected propeller and drive motor, and the intended use of the boat.

It should be understood that the truncated hollow partial cone tunnel structure and constant radius extension shown as installed for use in a single propeller Vee hull and would be useful as well in twin propeller driven hulls. The tunnel and extension would also be applicable to other hulls such as flat bottom boats, catamarans and trimarans. Further, the constant radius extension could be an insert placed in a truncated cone tunnel at the postion of the propeller and extending toward the stern at a constant radius to accomplish the desired efficiencies as described above.

The improved efficiency and reduced fuel consumption using the hull construction of the present invention is accomplished by getting the boat from standstill to planing attitude in a shorter period of time and by placing the drive propeller in its most efficient alignment with the water surface when the boat is planing. The constant radius extension 19 from the cone portion 18 forces the drive energy generated by the propeller to concentrate in the extension to the transom and thus increases the force at the transom to raise the boat into planing attitude. When in planing attitude, the propeller is operating with about one half of its blades out of the water and within the cone. The propeller should be constructed using modern technology that incorporates a ventilating aspect for a propeller operating in an air and water mix.

While certain preferred embodiments of the invention have been specifically disclosed, it should be understood that the invention is not limited thereto as many variations will be readily apparent to those skilled in the art and the invention is to be given its broadest possible interpertation within the terms of the following claims.

I claim:

1. A hull structure for a boat, said hull having a bottom, a bow, a stern, and a keel extending at least partially from said bow to said stern along said bottom, a propeller shaft extending from the interior of said hill through said bottom and toward said stern from between said bow and said stern and a propeller mounted for rotation with said propeller shaft, said hull structure comprising:

a) a tunnel along said bottom of said hull, said tunnel having a first portion presenting a truncated partial cylindrical cone shaped hollow surface indentation along a first portion of said bottom of said hull and a second portion presenting a constant radius extension from said first portion, said cone having a central axis and a cone angle with respect to said central axis, the smaller forward end of said cone extending toward said bow and the larger trailing end of said cone terminating at the location of said propeller within said tunnel and extending toward said stern, said second portion being connected to said first portion at said larger trailing end;

b) said end of said cone at its forward end being truncated with an end closure and connected to said hull bottom to provide a substantially normal connection between said truncated end and the axis of said propeller shaft extending through said end closure and boat bottom and into said tunnel, c) the cone angle of said cone being constant from said connected truncated end toward said larger trailing end to said connection with said second portion extension;

d) said cone being attached to said bottom along its exterior surfaces extending toward said stern and ending in attachment of said larger trailing end to said extension, said extension being attached to said bottom along its exterior surface extending toward said stern and ending in attachment to said stern to establish said hollow tunnel.

2. A device for assisting in getting a propeller driven boat from a starting attitude to a moving planing attitude, said boat having a bow, a stern and a bottom and a partially cylindrical cone shaped tunnel structure along its bottom from a forward end toward said bow along a portion of said bottom of said boat and a trailing end toward said stern of said boat, said tunnel structure accommodating a propeller shaft with a propeller at least partially within said tunnel structure between said forward end and said trailing end of said tunnel structure, the improvement in said trailing end of said tunnel structure comprising:

a constant radius extension of said tunnel structure from the position of said propeller within said tunnel structure to said stern of said boat, said extension having a forward end and a trailing end, said constant radius extension dimension being partially tubular in the form of said tunnel structure at said position of said propeller and having a central axis of formation toward said trailing end parallel to the line of a projection of the bottom of said boat, said constant radius extension being attached to said bottom of said boat along its sides and to said tunnel structure at its forward end, said extension being partially tubular at a constant radius beginning at the position of said propeller within said extension of said tunnel structure and with it trailing end extending at said constant radius with respect to the line of projection of said bottom toward said stern, said extension being attached to said stern at the end of its trailing end.

3. The device of claim 2 wherein said constant radius extension of said tunnel extends from the position of said propeller within said tunnel to said stern of said boat, said extension directing water pressure forces from said propeller when said propeller is rotating toward said stern to raise said stern and assist in getting said boat to planing attitude from said starting attitude.

4. The device of claim 2 wherein said tunnel structure at said forward end is a truncated partial cone shaped structure.

5. The device of claim 4 wherein said cone shaped structure is attached to said bottom at said truncated end and said cone shape terminates at a larger end where said propeller is attached to said propeller shaft.

6. The device of claim 5 wherein said constant radius extension is attached to said larger end of said cone where it terminates and extends at said constant radius to said stern of said boat.

7. The device of claim 6 wherein said cone shaped portion and said constant radius extension are attached to said boat hull from said bottom attachment at said truncated end to the end of said extension at said stern.

* * * * *

UNITED STATES PATENT AND TRADEMARK OFFICE

CERTIFICATE OF CORRECTION

PATENT NO. : 6,872,107 B1
DATED : March 29, 2005
INVENTOR(S) : Douglas G. Paulo

It is certified that error appears in the above-identified patent and that said Letters Patent is hereby corrected as shown below:

Title page,
Item [75], Inventors, the address should be -- 20674 Forest Ave. --.

Column 1,
Line 19, “cone is” should be -- cone’s --.

Signed and Sealed this

Fourth Day of October, 2005

JON W. DUDAS
*Director of the United States Patent and Trademark Office*